US005102349A

United States Patent [19]

Kato et al.

[11] Patent Number: 5,102,349

[45] Date of Patent: Apr. 7, 1992

[54] DETECTOR DEVICE FOR COUPLED CONNECTOR

[75] Inventors: Tetsuo Kato; Naoto Taguchi; Yoshihiro Murakami, all of Shizuoka, Japan

[73] Assignee: Yazaki Corporation, Tokyo, Japan

[21] Appl. No.: 748,142

[22] Filed: Aug. 21, 1991

Related U.S. Application Data

[62] Division of Ser. No. 673,932, Mar. 21, 1991.

[30] Foreign Application Priority Data

Mar. 23, 1990 [JP] Japan ..... 2-72063
May 2, 1990 [JP] Japan ..... 2-115115
May 2, 1990 [JP] Japan ..... 2-115116

[51] Int. Cl.[5] ..... H01R 3/00
[52] U.S. Cl. ..... 439/489; 439/188
[58] Field of Search ..... 439/188, 350, 352, 357, 439/488, 489, 490, 491, 507, 509; 200/51.09, 51.1

[56] References Cited

U.S. PATENT DOCUMENTS 4,900,267 2/1990 Nagasaka et al. ..... 439/489
4,915,648 4/1990 Takase et al. ..... 439/489 X
4,950,179 8/1990 Takenouchi et al. ..... 439/352
4,993,967 2/1991 Matsumoto ..... 439/489

*Primary Examiner*—Neil Abrams
*Assistant Examiner*—Khiema Nguyen
*Attorney, Agent, or Firm*—Armstrong, Nikaido, Marmelstein, Kubovcik & Murray

[57] ABSTRACT

A detector circuit for coupled connectors is provided with one connector housing, the other connector housing and a lock confirming slider. A sensor circuit terminal and a short-circuiting terminal are oppositely arranged in respect to the one connector housing and the lock confirming slider. Springs are arranged between the terminals. The lock confirming slider is moved forward by the springs when both connector housings are completely fitted to each other. Thus, the sensor circuit terminal and the short-circuiting terminal are contacted to each other.

2 Claims, 25 Drawing Sheets

(b)

DETECTOR DEVICE FOR COUPLED CONNECTOR

This is a division of application Ser. No. 673,932 filed Mar. 21, 1991.

BACKGROUND OF THE INVENTION

1. Field of the Invention

This invention relates to a detector device for a connector having means for detecting whether a pair of connectors to be used for connecting an automobile wire harness are normally performed or not.

2. Description of the Prior Art

In a prior art, a fitting condition of an electric connector, for example, consisting a male connector housing and a female connector housing is visually checked based on the position of the connector housings. When elements such as lock confirming slider is provided to confirm the fitting condition of the connector, the position of the elements may be visually checked. In these cases, the visual inspection is insufficient to detect any incomplete fitting state.

SUMMARY OF THE INVENTION

The present invention has been invented in view of the aforesaid matter and detects an electrical complete fitting of the connectors having such a lock confirming slider.

In order to accomplish the aforesaid object, the present invention is constructed such that it is comprised of a first connector housing having a flexible lock arm, a second connector housing having an engaging part in respect to the flexible lock arm and a lock confirming slider arranged in the first connector housing and capable of being moved forward when both connector housings are completely fitted to each other, wherein a sensor circuit terminal and a short circuiting terminal are oppositely arranged to face against the first connector housing and the lock confirming slider and at the same time springs are tensioned between them, the lock confirming slider is moved forward by the springs when both connector housings are completely fitted and the sensor circuit terminal and the short circuiting terminal are contacted to each other.

The first connector housing is provided with sensor circuit terminals and a short circuiting and automatic lock confirming resilient pieces, the lock confirming slider is automatically advanced by the short circuiting and automatic lock confirming resilient piece under a complete fitted state of both connector housings and at the same time the short circuiting automatic lock confirming resilient piece is contacted with the sensor circuit terminals, the first connector housing is provided with a sensor circuit terminal and at the same time the lock confirming slider is provided with a short circuiting and automatic lock confirming resilient piece, the lock confirming slider is automatically moved forward by the short circuiting and automatic lock confirming resilient piece under a complete fitted state of both connector housings, and the short circuiting and automatic lock confirming resilient piece is contacted with the sensor circuit terminal.

The lock detector arm is automatically moved forward and the short circuiting and automatic lock confirming resilient piece is contacted with the sensor circuit terminals.

DESCRIPTION OF THE PREFERRED EMBODIMENTS

Figure 1A:
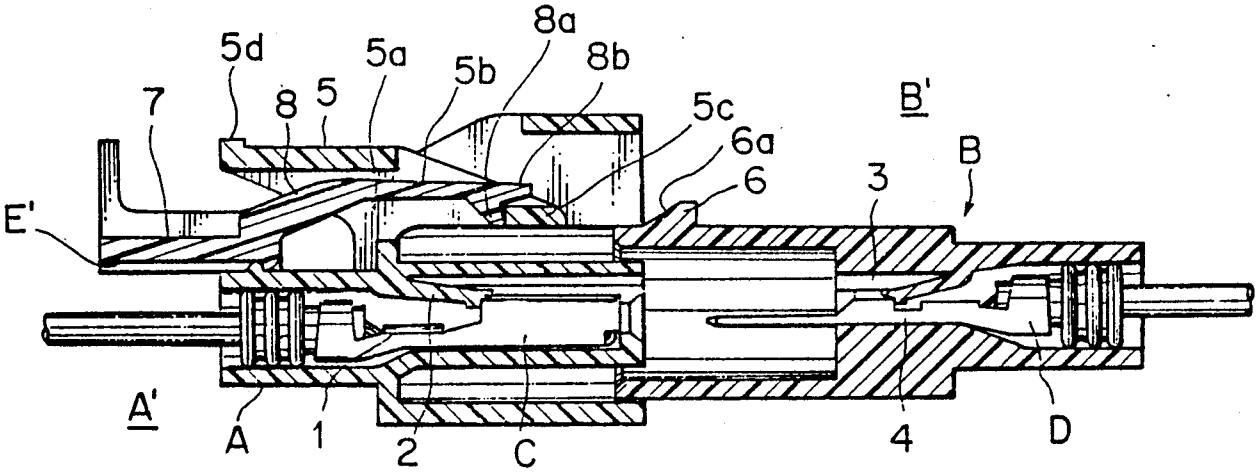
FIGS. 1A to 1F are sectional views for fitting steps for a pair of connector housings in preferred embodiment of the present invention.

In FIGS. 1A to 1F, A' denotes a male connector in which a female terminal C is held by a flexible engaging piece 2 within a terminal storing chamber of a male connector housing A. B' denotes a female connector in which a male terminal D is held by a flexible engaging piece 4 within a terminal storing chamber 3 of a female connector housing B.

The male connector housing A is provided with a lock arm 5 by a flexible supporting part 5*a*. An engaging part 5*c* formed at an extreme end of a front side longitudinal hole 5*b* is engaged with an engaging projection 6 arranged at a surface of the female connector housing B. A rear end of the lock arm 5 is provided with a lock releasing operating part 5*d*.

The male connector housing A is provided with a lock confirming slider E' in such a way as it may be moved in an aft and fro direction. A canti-levered flexible lock detecting arm 8 is projected from its base end 7 forwardly, and the lock detecting arm 8 has at its extreme end an abutting part 8*a* and a supporting part 8*b*. The arm extends into the longitudinal hole 5*b* of the lock arm 5, the abutting part 8*a* abuts against a rear surface of the engaging part 5*c* and at the same time the supporting part 8*b* abuts to the upper surface of the engaging part 5*c*. Thus, as shown in FIG. 1A, before fitting the male connector housing A and the female connector housing B, a forward movement of the lock confirming slider E' is prevented by the engaging part 5*c* of the lock arm 5.

Figure 1C:
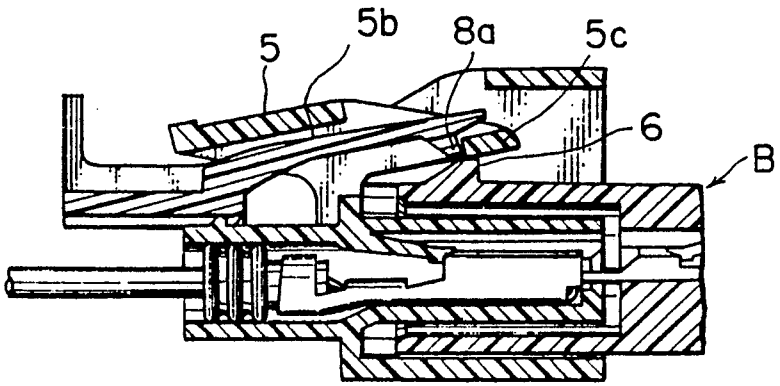
Figure 1B:
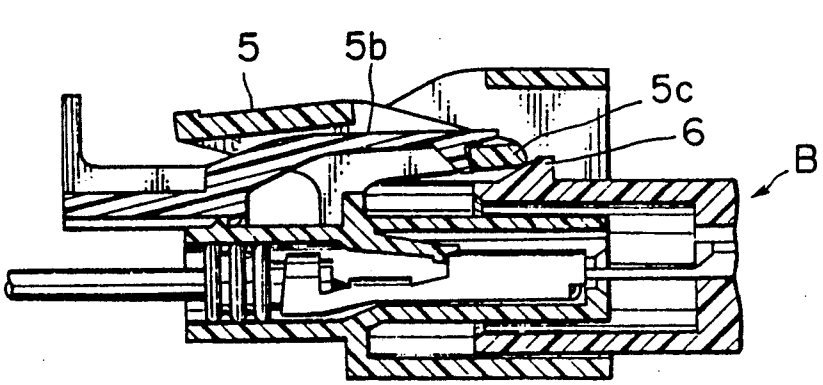
Figure 1D:
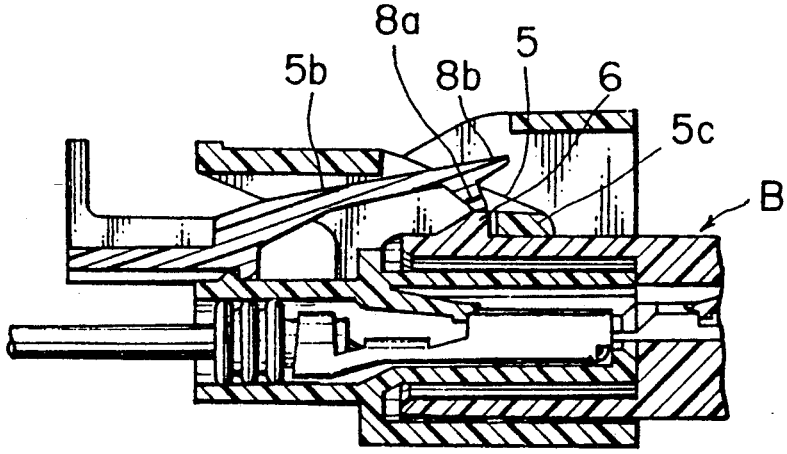
Figure 1E:
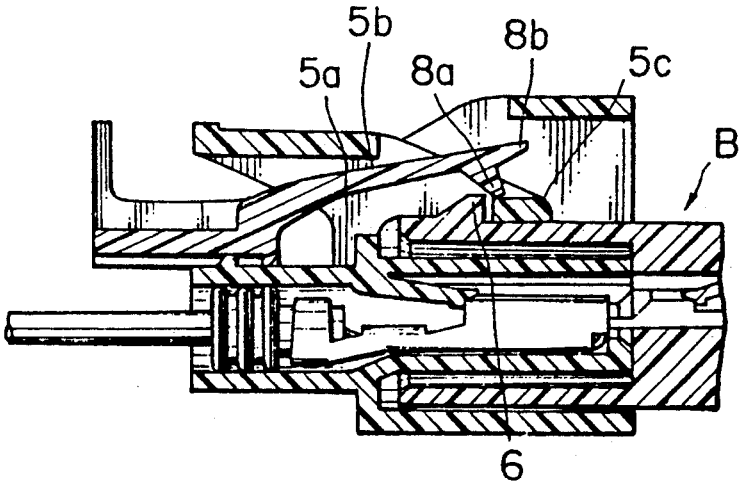
Figure 1F:
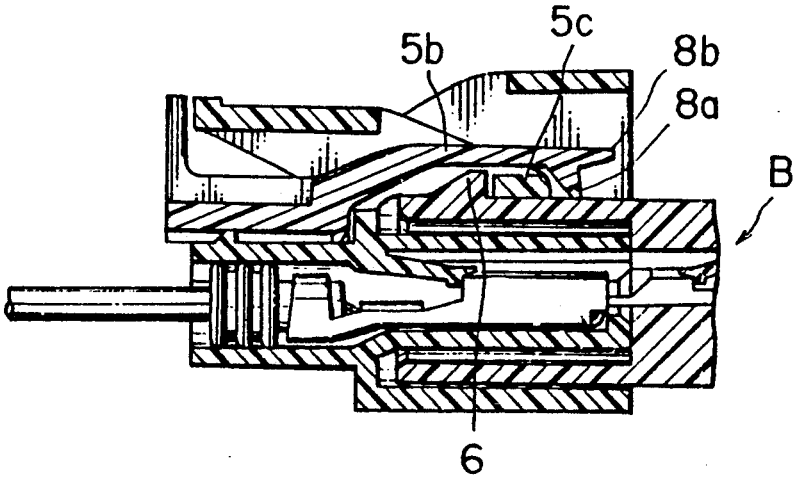

When the male connector housing A and the female connector housing B are fitted to each other, the engaging part 5*c* of the lock arm 5 is moved upwardly along a tapered guide surface 6*a* of an engaging projection 6, thereby a detecting arm 8 is also moved upwardly (FIG. 1B and 1C). As the engaging part 5*c* rides over the engaging projection 6, the lock arm 5 descends and the abutting part 8*a* is positioned on the engaging projection 6, thereby the lock detecting arm 8 is released from the engaged relation with the lock arm 5 to occupy a rised position by itself (FIG. 1D). Then, under this condition, it becomes possible to move the lock confirming slider E' forwardly and then a complete fitted state of the male connector A' and the female connector B' is confirmed.

Figure 2:
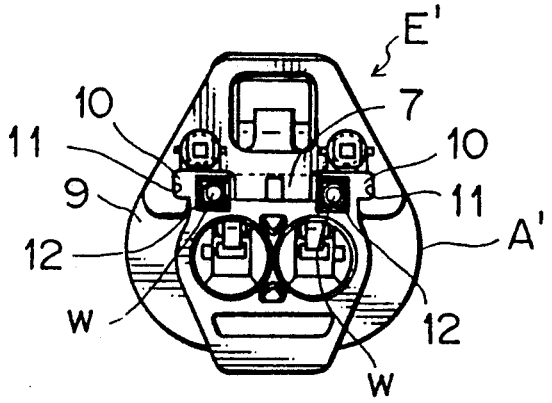
FIG. 2 is a rear view for showing one preferred embodiment of the present invention.

In FIG. 2, the male connector housing A' has a lock confirming slider E' which can be moved forward when it is completely fitted to a mating female connector housing (not shown).

Figure 3:
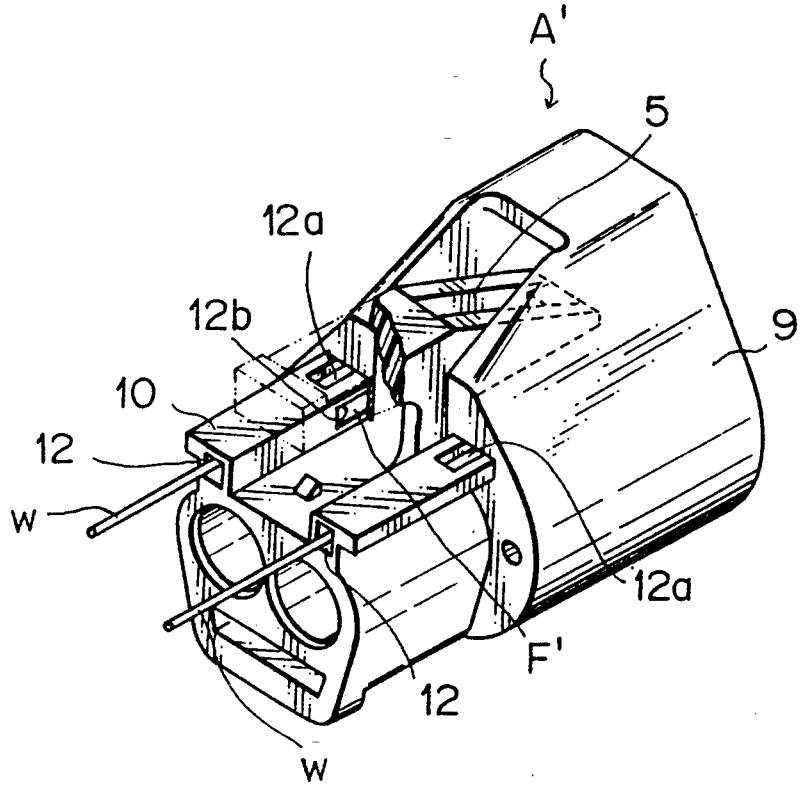
FIG. 3 is a perspective view with a part of a connector housing of the present invention being partly broken away.

The male connector housing A' is provided with a jacket 9 enclosing a mating female connector housing at its front half part, in which a pair of rails 10 are extended from a rear part of the jacket 9, grooves 11 formed at both sides of a base portion 7 of the lock confirming slider E' are engaged with the rails 10. The pair of rails 10 are formed with terminal accommodating cavities 12 opened rearwardly. (See FIG. 3).

To the terminal accommodating cavities 12 are inserted small-sized sensor circuit terminals F' connected to the wires (w) in advance. Engaging pieces $F_1'$ is engaged with an upper opening 12*a* so as to prevent its removal and then the terminal F' is exposed at an inner opening 12*b*.

A substantial V-shaped short circuiting resilient contact element G' is arranged by fitting its base end to a substantial V-shaped supporting groove 7*a* formed at the base portion 7 of the lock confirming slider E', and its contact end $G_1'$ can be contacted with the sensor circuit terminal F' through the opening 12*b*.

Figure 5A:
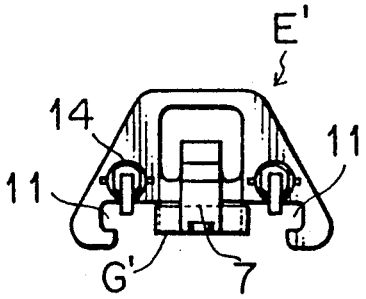
FIG. 5A is a rear view.
Figure 5B:
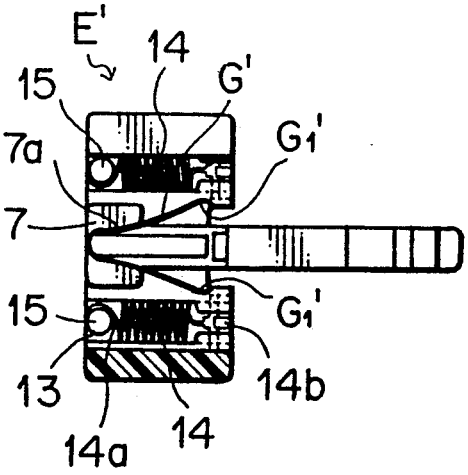
FIG. 5B is a bottom view and FIG. 5C is a sectional view for showing a lock confirming slider of the present invention, respectively.
Figure 5C:
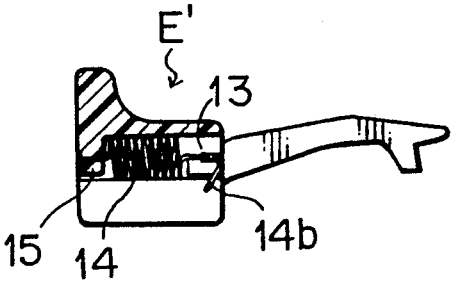
Figure 4:
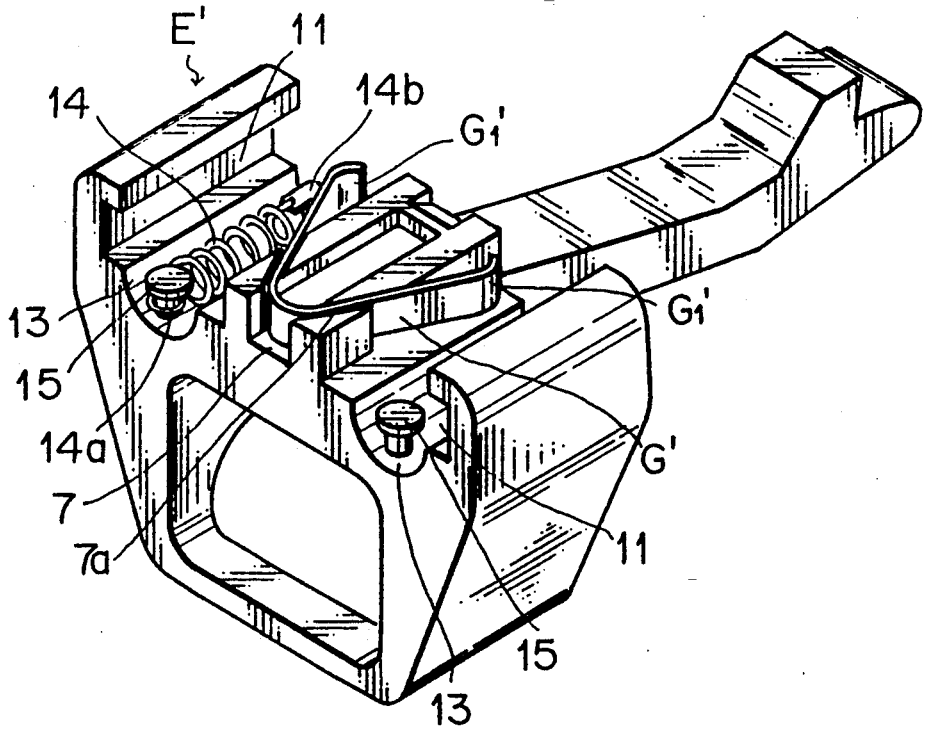
FIG. 4 is perspective view for showing an internal structure of a lock confirming slider of the present invention.

As shown in FIGS. 4 and 5, spring storing grooves extending in a longitudinal direction are formed at positions opposing to the terminal storing chamber 12 at both sides of the base portion 7 of the lock confirming slider E'. The spring storing grooves 13 store tension type automatic lock confirming coil springs 14 having rear ends 14*a* engaged with the fixing pins 15 and further having hook leaf springs 14*b* at front free ends thereof.

Figure 6A:
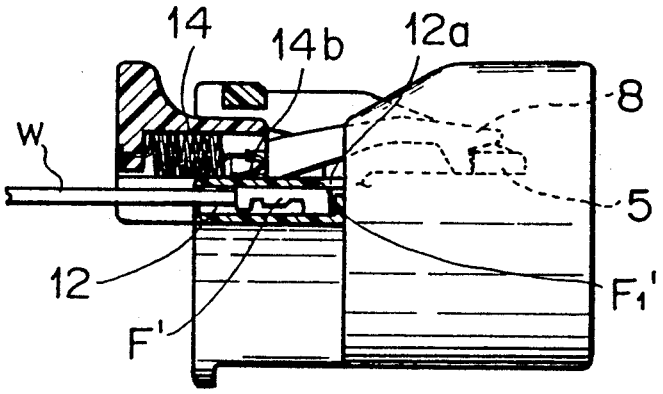
FIGS. 6A, 6B and 6C are sectional views for showing processes for engaging the springs of the lock confirming slider to a connector housing.
Figure 6B:
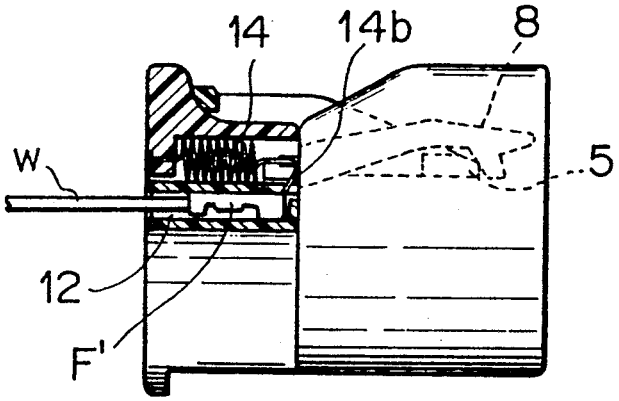
Figure 6C:
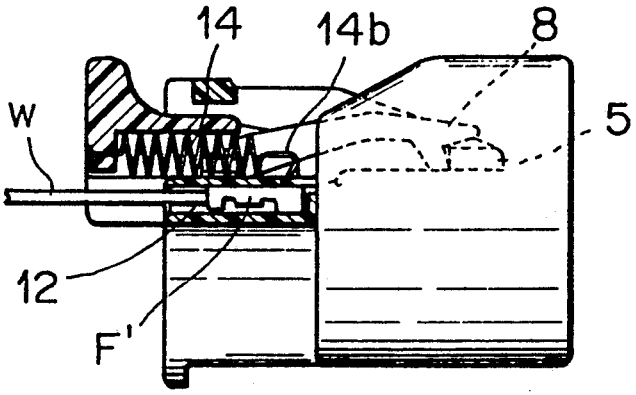
Figure 7:
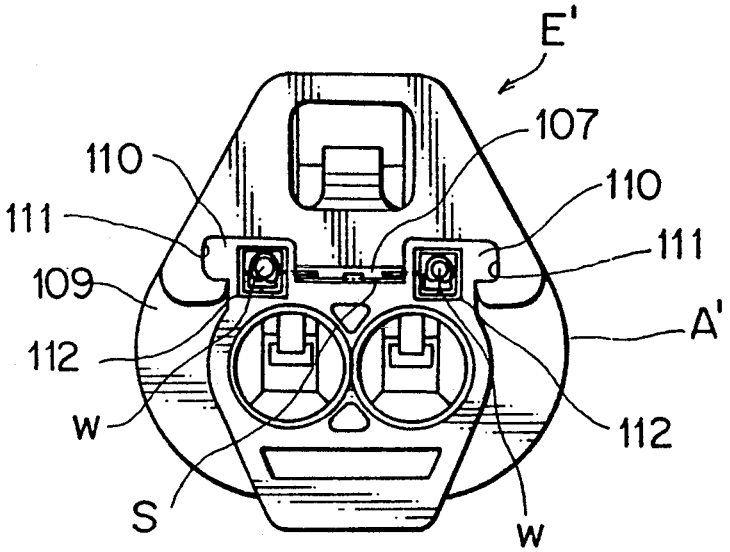
FIG. 7 is a rear view for showing one preferred embodiment of the present invention.
Figure 8:
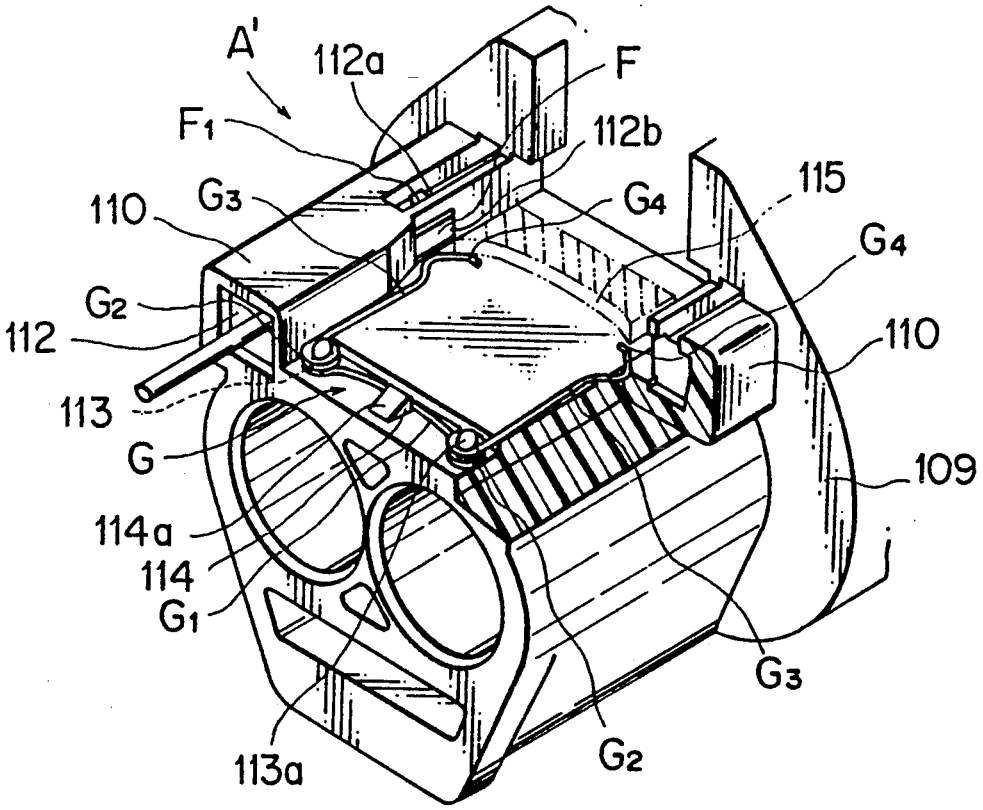
FIG. 8 is a perspective view with a part of a connector housing of the present invention being broken away.
Figure 9:
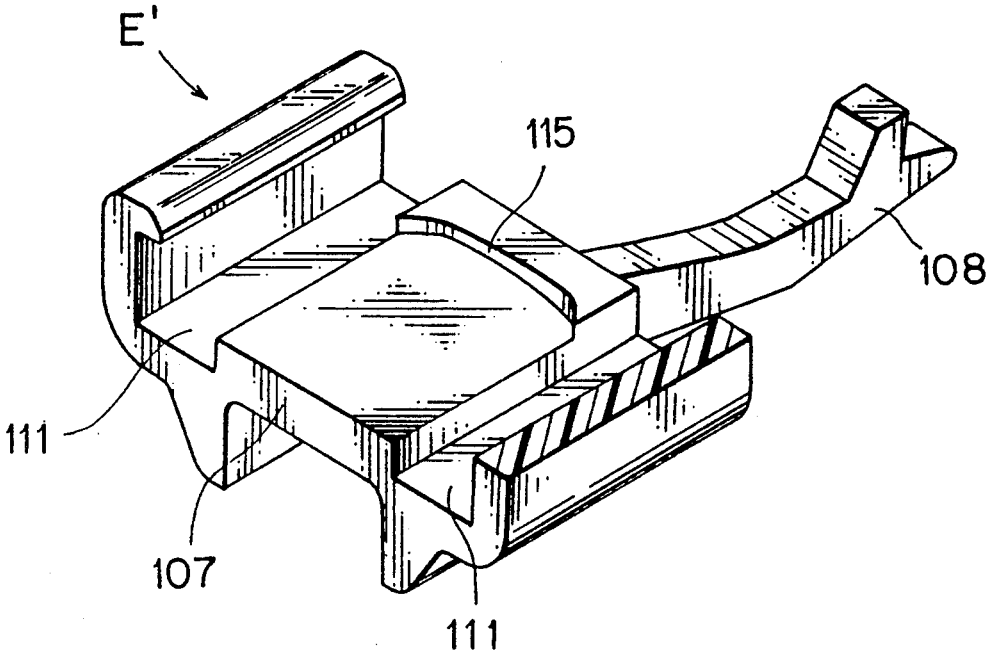
FIG. 9 is a perspective view with a part of a lock confirming slider being broken away.

The lock confirming slider E' is at first combined with the male connector housing A' under a condition shown in FIG. 6A, a lock arm 5 is pushed down by a jig to disengage a lock sensor arm 8, thereby it is advanced to cause the hook leaf spring 14*b* to engaged with the upper opening 12*b* of the terminal storing chamber 12 (FIG. 6B). Under this condition, the lock confirming slider E' is retracted again while tensioning the coil spring 14, and then an abutting part 8*a* of the lock sensor arm 8 is engaged with the engaging part 5*c* of the lock arm 5 and fixed. (FIG. 6C).

With such an arrangement above, when a complete fitting with a mating connector is attained, the lock confirming slider E' released a restriction with the lock arm 5 automatically advances with a tension force of the coil springs 14, a contact end $G_1'$ of the short circuiting resilient contact element G' is contacted with sensor circuit terminals F' through an opening 12*a* so as to close a sensor circuit.

Figure 11:
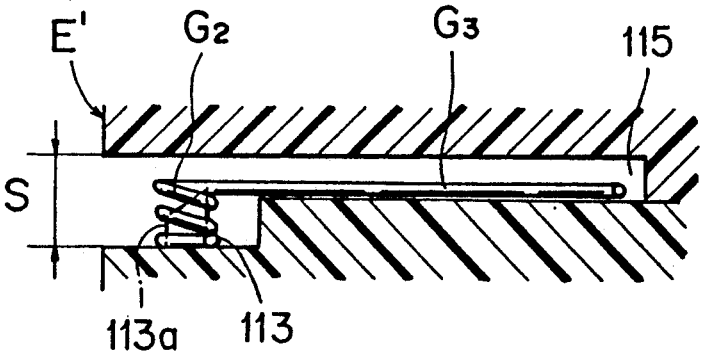
FIG. 11 is a detailed view for showing a fixing part of a short circuiting and automatic lock confirming resilient piece.

Between a pair of rails 110 of the male connector housing A', two fixing winding portions $G_2$ formed at corners of about U-shaped short circuiting automatic lock confirming resilient piece G are engaged with fixing levers 113. Base portion $G_1$ is engaged with a biasing projection 114, thereby both resilient contact portions $G_3$ are arranged so as to be contact able with the sensor circuit terminals F through the openings 112*b*. There are provided driven portions $G_4$ continuous with the resilient contact portions $G_3$ and bent inwardly. End surfaces of the fixing levers 113 and the biasing projection 114 are formed as tapered surfaces 113*a* and 114*a*. Under a condition in which the lock confirming slider E' is installed in the male connector housing A', the short circuiting automatic lock confirming resilient piece G is pushed into a clearance S at the rear part to cause the fixing windings $G_2$ and the base portion $G_1$ to be engaged with the fixing levers 113 and the biasing projection 114 through the tapered surfaces 113*a* and 114*a*. (FIG. 11).

In front of the base portion 107 of the lock confirming slider E' is formed a curved driving surface 115 in opposition to the driven portions $G_4$ of the short circuiting automatic lock confirming resilient piece G. A pair of driven portions $G_4$ and $G_4$ are abutted against the curved driving surface 115 while being displaced vertically.

Figure 10A:
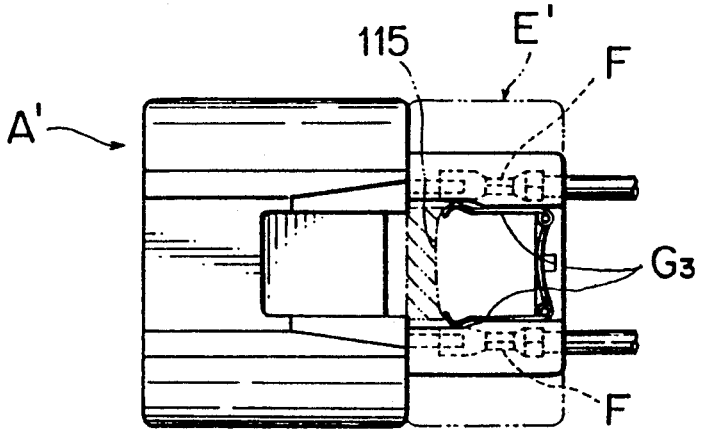
FIGS. 10A, 10B and 10C are top plan views for showing a connector housing to illustrate its relation with the lock confirming slider.
Figure 10B:
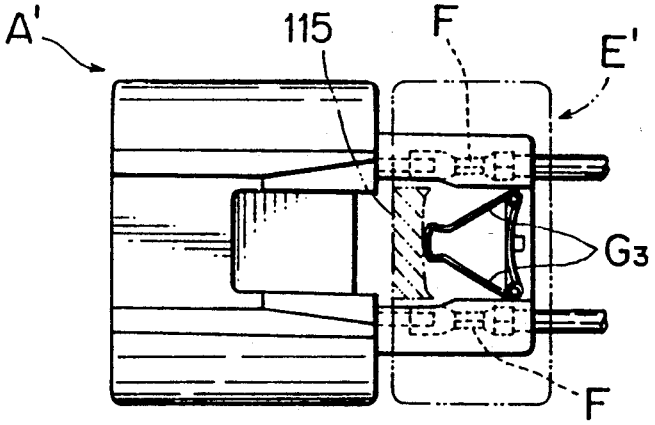
Figure 10C:
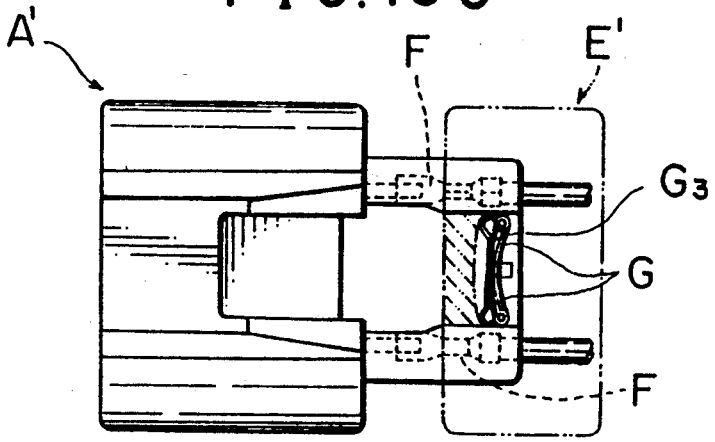

At first as shown in FIG. 10A, the lock confirming slider E' is operated such that a lock arm 105 is pushed down by a jig to release the engagement with the lock sensor arm 108 and the short circuiting automatic lock confirming resilient piece G is installed in the male connector housing A' while it is moved forward, and under this condition the lock confirming slider E' is retracted (FIG. 10B). At this time the curved driving surface 115 causes the short circuiting automatic lock confirming resilient piece G to be displaced inwardly through the driven portions $G_4$ against their resiliencies. The abutting part 108*a* of the lock sensor arm 108 is engaged with the engaging part 105*c* of the lock arm 105 through its further retracting movement and is fixed at its preset state. Under this state, both resilient contact portions $G_3$ of the short circuiting automatic lock confirming resilient piece G are bent inwardly against their resiliencies. (FIG. 10C).

With such an arrangement as above, the lock confirming slider E' released from its restriction with the lock arm 105 under a complete fitting with its mating connector is moved forward automatically by resilient forces of the bent resilient contact portions $G_3$ (see FIG. 10C) and at the same time the resilient contact pieces $G_3$ are contacted with the sensor circuit terminals F to close the sensor circuit. (FIG. 10A).

Figure 12:
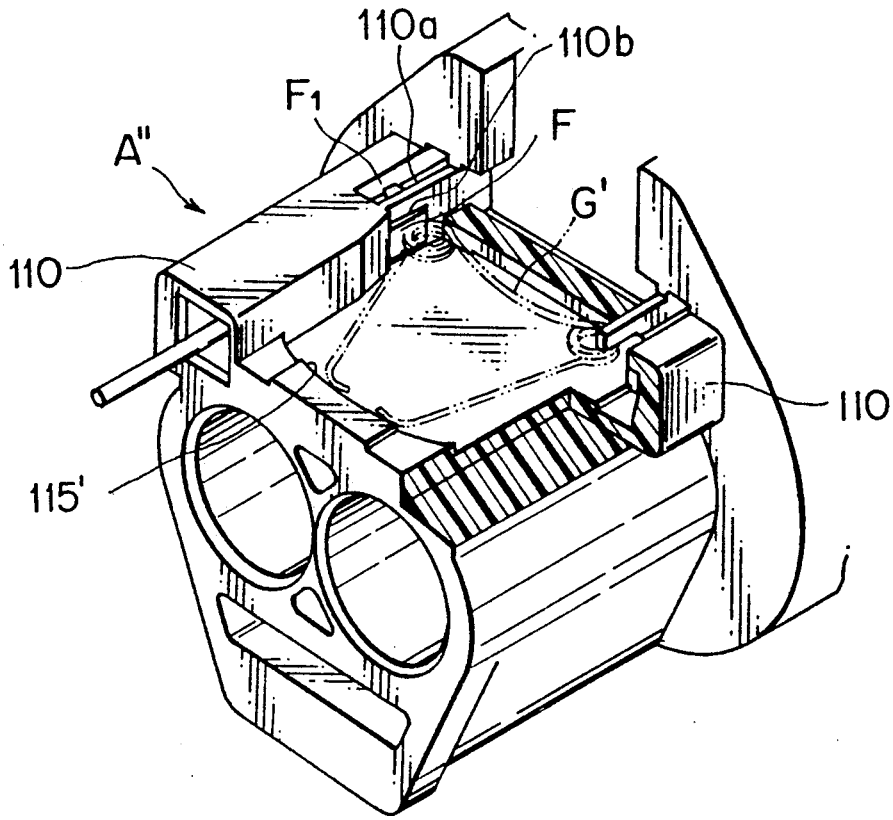
FIG. 12 is a perspective view with a part of a connector housing of another preferred embodiment of the present invention being broken away.
Figure 13:
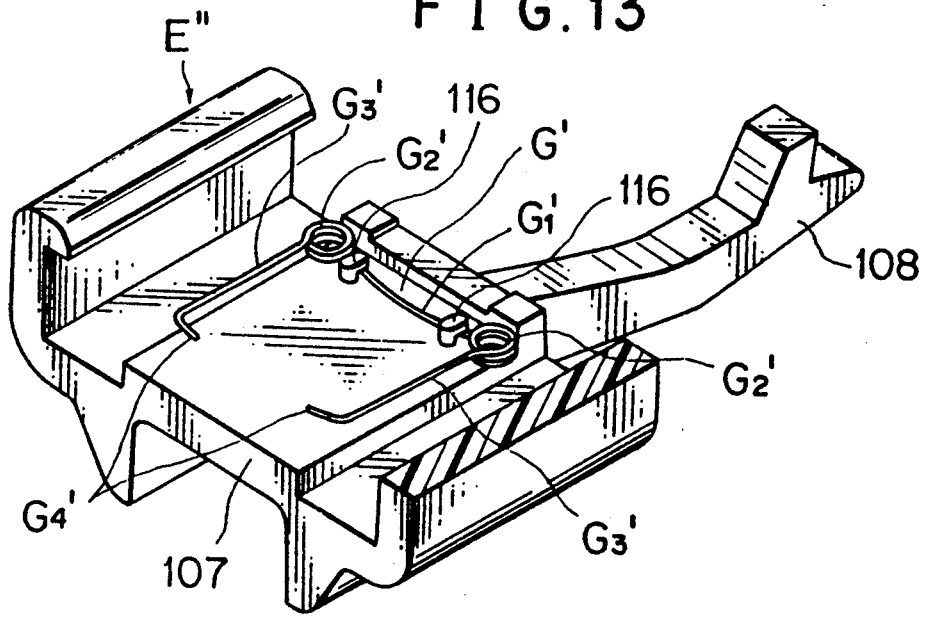
FIG. 13 is a perspective view with a part of the lock confirming slider being broken away.

In case of the preferred embodiment shown in FIGS. 12 and 13, a forward curved driving surface 115' is formed at a rear end between a pair of rails 110 of the male connector housing A''. A short circuiting automatic lock confirming resilient piece G' is fixed to the base portion 107 of the lock confirming slider E''.

The short circuiting automatic lock confirming resilient piece G' has contact portions $G_2'$ wound around bent portions between a base portion $G_1'$ and each of a pair of resilient displacement portions $G_3'$, has driven portions $G_4'$ bent inwardly at its free ends, in which the base portion $G_1'$ is supported by the engaging portions 116 to cause the driven portions $G_4'$ to be oppositely facing against the curved driving surface 115' at the male connector housing A''.

Figure 14A:
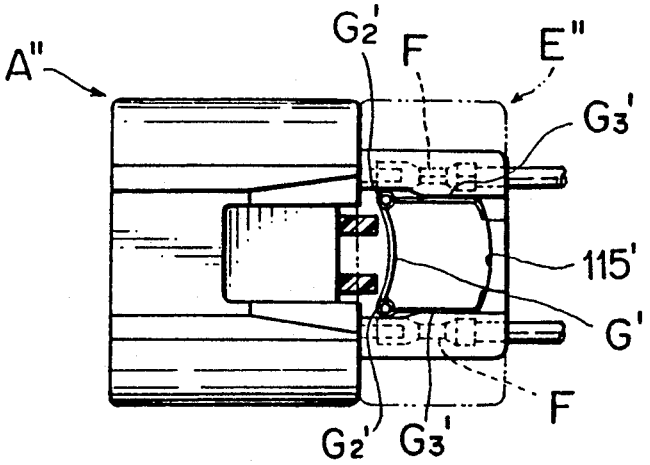
FIGS. 14A, 14B and 14C are top plan views of the connector housing to show a relation with the lock confirming slider.
Figure 14B:
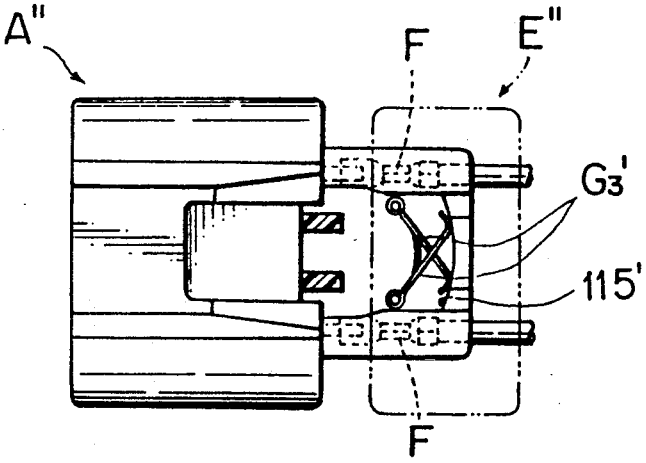
Figure 14C:
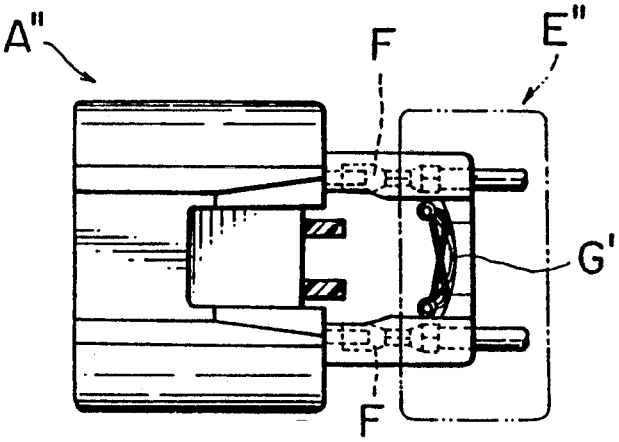

With such an arrangement, as shown in FIG. 13, the lock confirming slider E'' assembled with the short circuiting automatic lock confirming resilient piece G' is assembled with the male connector housing A'' at its rear part and moved forward, thereby the driven portions $G_4'$ are engaged with the curved driving surface 115' (FIG. 14A), and then pulled down until the lock sensor arm 108 is engaged with the lock arm and preset (FIG. 14C).

Under the preset condition, the lock confirming slider E'' is already retracted, so that the resilient displacement portions $G_3'$ is bent inwardly by the curved driving portion 115'. When the male connector housing A'' is completely fitted with its mating connector housing, the lock confirming slider E'' starts to advance due to the resilient displacement portions $G_3'$ (FIG. 14B) and the contact portions $G_2'$ are contacted with the sensor circuit terminals F at the most-forward position to close the sensor circuit (FIG. 14A).

Figure 15:
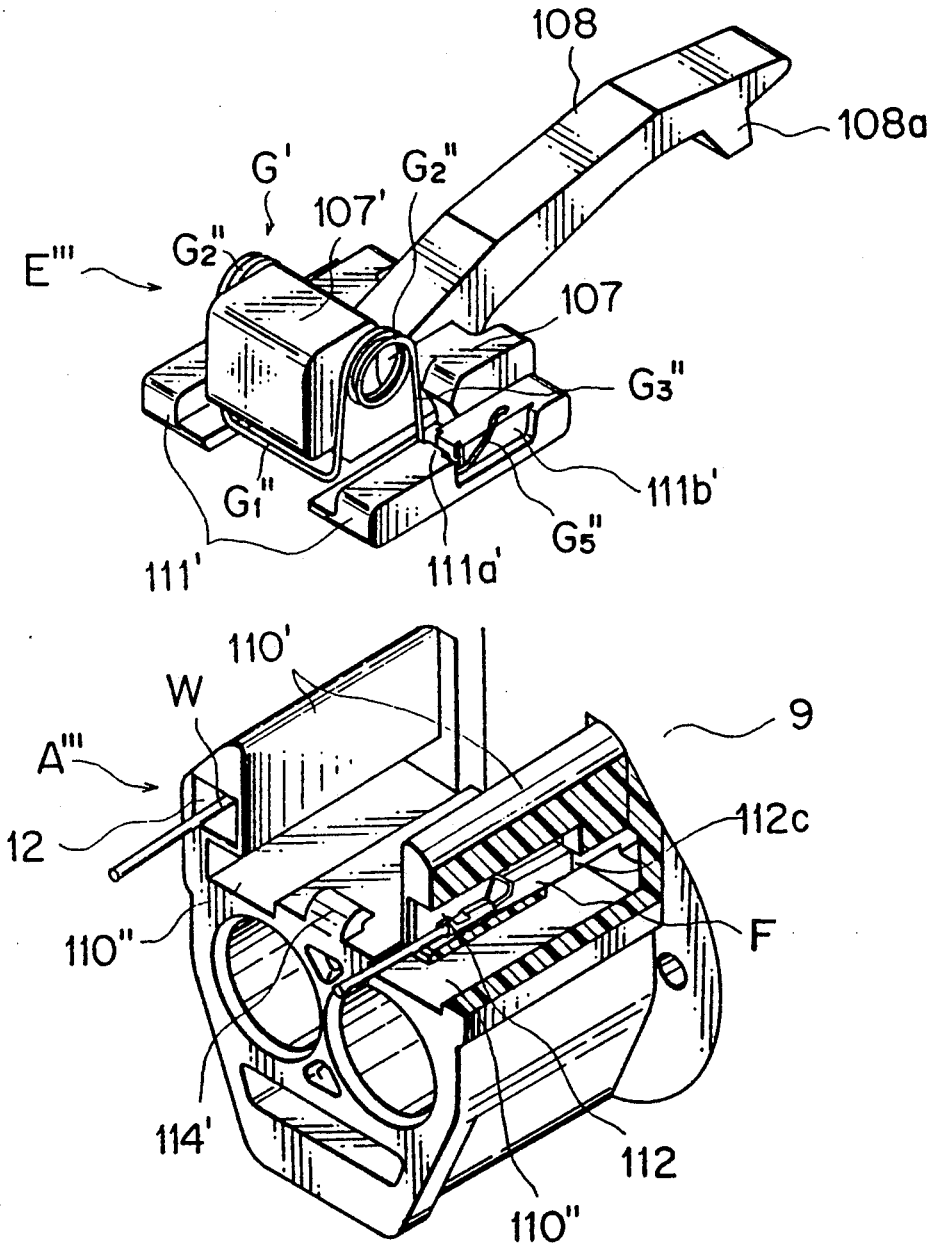
FIG. 15 is an exploded perspective view for showing a still further preferred embodiment of the present invention.

In the preferred embodiment shown in FIGS. 15 to 17, a pair of supporting frames 110' are extended rearwardly from the rear part of a male connector housing A''', sliding frames 111' formed at both sides of the lock confirming slider E''' are engaged in the grooves 110'' formed by the supporting frames 110'. A pair of supporting frames 110' are formed with terminal accommodating cavities 112 opened rearwardly, respectively.

Into the terminal accommodating cavities 112 are inserted and engaged the small-sized sensor circuit terminals F connected in advance with an electrical wire in the same manner as that of the aforesaid preferred embodiment and they are exposed at the lower openings 112*c* adjacent to the grooves 110''.

To a rear part of a base portion 7 of the lock confirming slider E''' is cooperatively arranged a pusher operating part 107', and the short circuiting automatic lock confirming resilient pieces G'' are arranged over between the sliding frames 111' set at both lower sides. The short circuiting automatic lock confirming resilient pieces G'' has biasing wound portions $G_2''$ on a U-shaped base portion $G_1''$, has resilient displacement portions $G_3''$ directed downwardly from the biasing wound portions $G_2''$ and has resilient contact portions $G_5''$ bent forwardly at each of the resilient displacement portions $G_3''$, $G_3''$ through supporting shaft portions $G_4''$, $G_4''$ bent outwardly.

The sliding frames 111'' are formed with supporting grooves 111*a'* in a direction crossing with a moving direction of the lock confirming slider E''', and outside portions thereof are provided with storing concave portions 111*b'* opened upwardly in continuous with the supporting grooves 111*a'*.

As shown in FIG. 15, the short circuiting automatic lock confirming resilient piece G'' is operated such that each of the supporting shaft portions $G_4''$ is assembled with the lock confirming slider E''' while each of the supporting shaft portions $G_4''$ is engaged with the supporting grooves 111*a'* of the sliding frames 111' and the resilient contact portions $G_5''$ are positioned within the storing concave portions 111*b'*. In this case, each of the biasing wound portions $G_2''$ is positioned at a side part of the pusher operating part 107' and the U-shaped base portion $G_1''$ is positioned below the pusher operating part 107'.

Figure 16A:
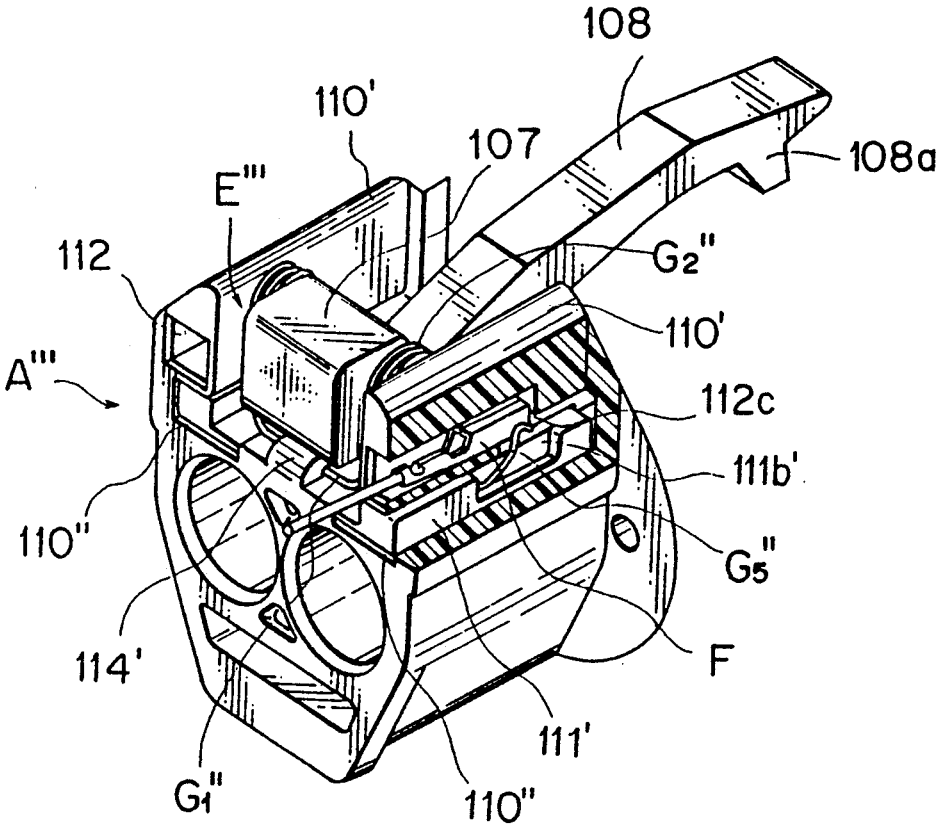
FIGS. 16A and 16B are a perspective view showing a state in which the lock confirming slider is advanced in respect to the connector housing and an operational state view for showing a short circuiting and automatic lock confirming resilient piece.
Figure 16B:
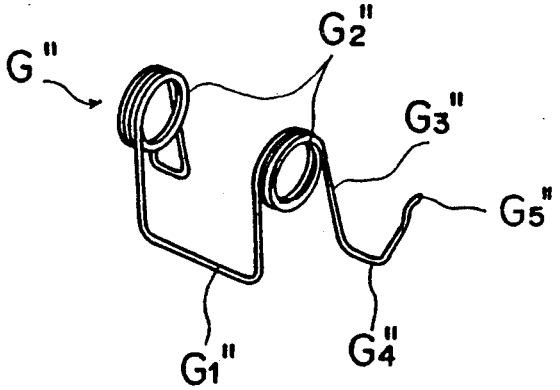

The lock confirming slider E''' assembled with the short circuiting lock confirming resilient pieces G'' cause at first both sliding frames 111' to be inserted at the rear part of the male connector housing A''' into the grooves 110'' and further cause the U-shaped base portion $G_1''$ to be engaged with a biasing projection 114' raised at a rear end between the groves 110'' and 110'' of the male connector housing A''', and under this state, the resilient contact portions $G_5''$ are contacted with the sensor circuit terminals F from the openings 112*c* (FIGS. 16A and 16B).

Figure 17A:
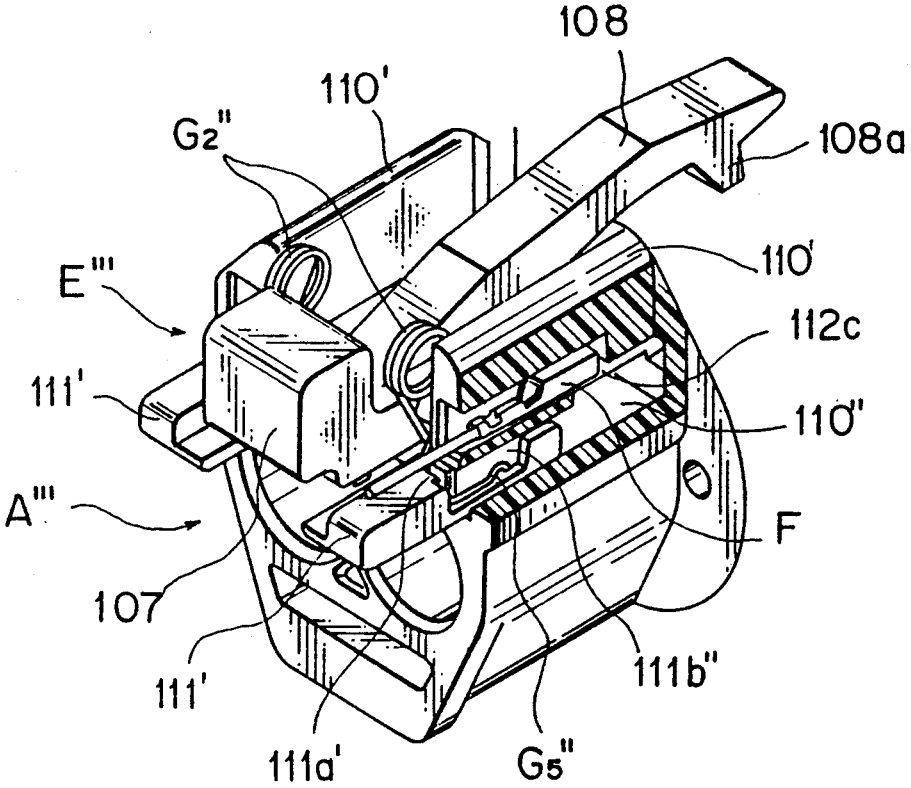
FIGS. 17A and 17B are a perspective view or showing a state in which the lock confirming slider is retracted in respect to the connector housing and an operating state view for showing a short circuiting and automatic lock confirming resilient pieces.
Figure 17B:
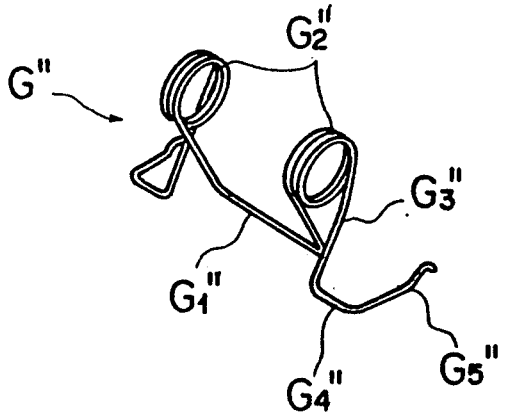

Then, as indicated in the prior art, the lock confirming slider E''' is pulled down until the abutting part 108*a* of the lock sensing arm 108 is engaged with the lock arm, and then it is preset (FIGS. 17A and 17B). Under this condition, the U-shaped base portion $G_1''$ of the short circuiting automatic lock confirming resilient piece G'' approaches resilient displacement portions $G_3''$ and a strong resilient force is accumulated in the biasing wound portions $G_2''$.

With such an arrangement as above, when the male connector housing A''' is completely fitted to its mating connector housing, the lock confirming slider E''' is moved forward under a biasing action of the resilient displacement part $G_3''$ or the like and the resilient contact part $G_5''$ is contacted with the sensor circuit terminal F to close the sensor circuit (see FIG. 16).

Figure 18:
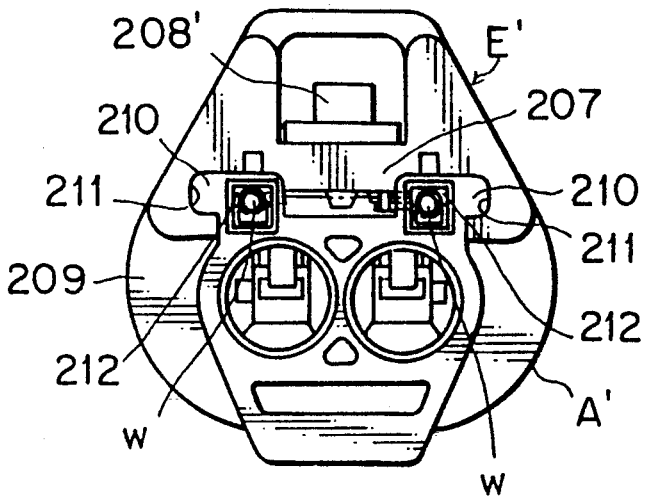
FIG. 18 is a rear view for showing one preferred embodiment of the present invention.

In FIG. 18, the male connector housing A' is separately provided with a supporting member E', and a flexible lock sensor arm 208' is slidably supported in respect to the supporting member E' toward a fitting direction of the male connector housing A'. An engaging structure between the lock sensor arm 208' and the lock arm 205 is the same as that shown in FIG. 1.

Figure 19:
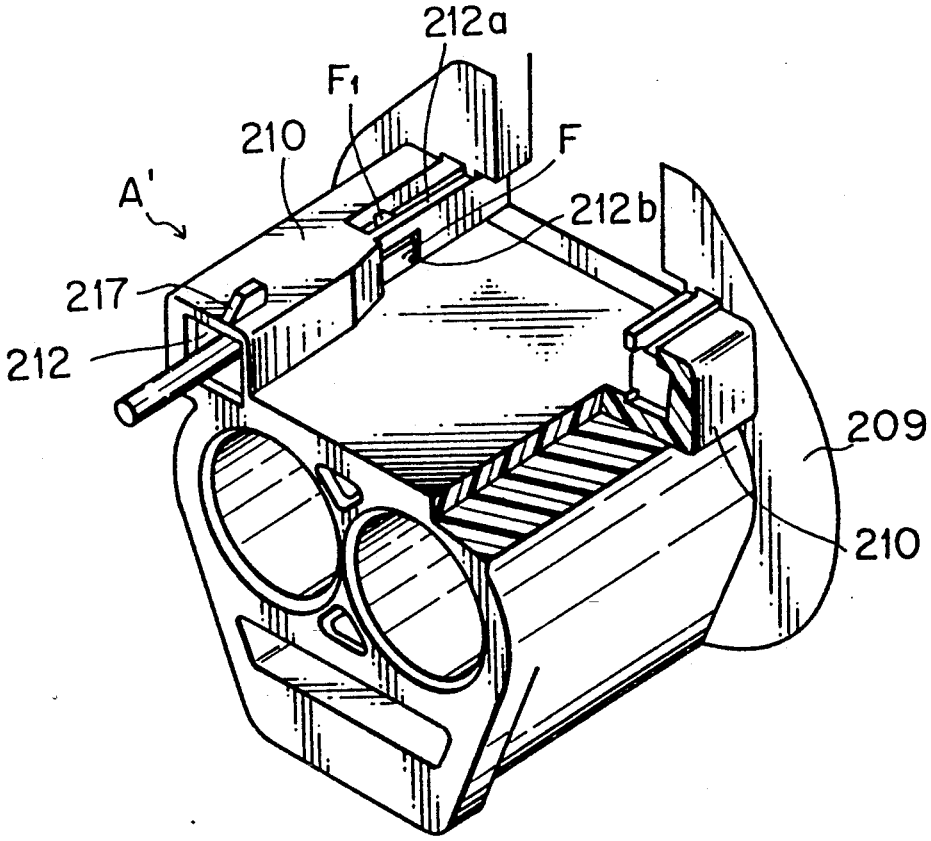
FIG. 19 is a sectional view with a part of the connector housing being broken away.

The male connector housing A' is provided with a jacket 209 at its front half part for enclosing a mating female connector housing A pair of rails 210 are extended rearwardly from the rear part of the jacket 209. Grooves 211 formed at both sides of the base portion 207 of the supporting member E' are engaged with the rails 210. The pair of rails 210 are formed with the terminal accommodating cavities 212 opened rearwardly, respectively (see FIG. 19).

Small-sized sensor circuit terminals F connected to electrical wires W in advance are inserted into the terminal accommodating cavities 212 to cause the engaging pieces $F_1$ to be engaged with the upper openings 212*a* and the terminals F are exposed at the inner openings 212*b*.

Figure 20:
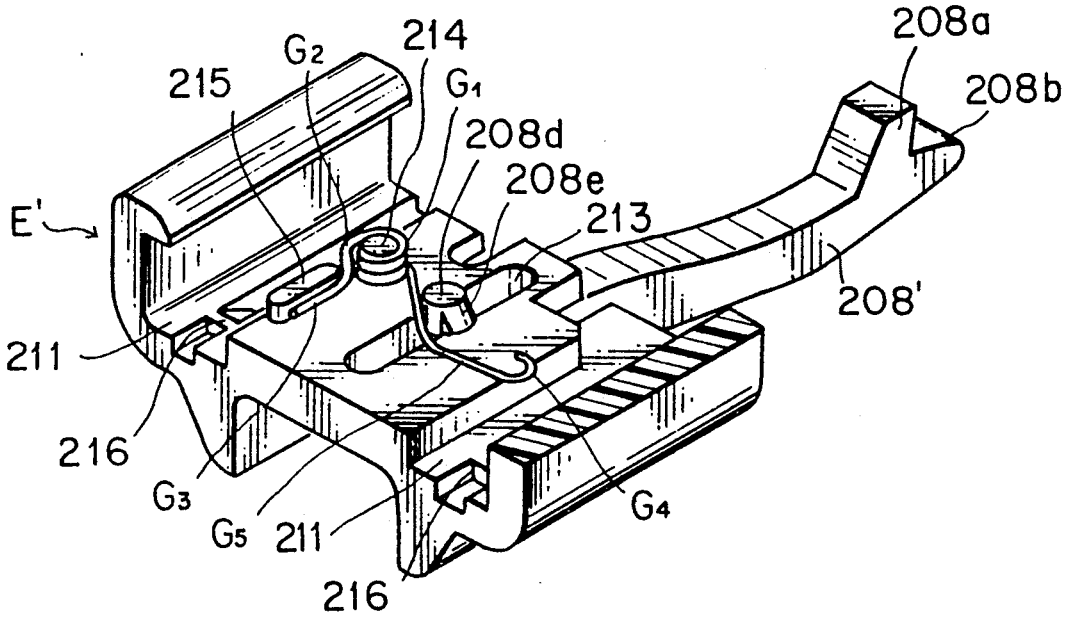
FIG. 20 is a perspective view for showing a lock sensor arm and its supporting member.

The base portion 207 of the supporting member E' is formed with a guide longitudinal hole 203 in a longitudinal direction, i.e. toward a fitting direction of the male connector housing A', and the lock sensor arm 208' is arranged in the guide longitudinal hole 213 in such a way as it may be moved in a longitudinal direction (see FIG. 20).

Figure 21A:
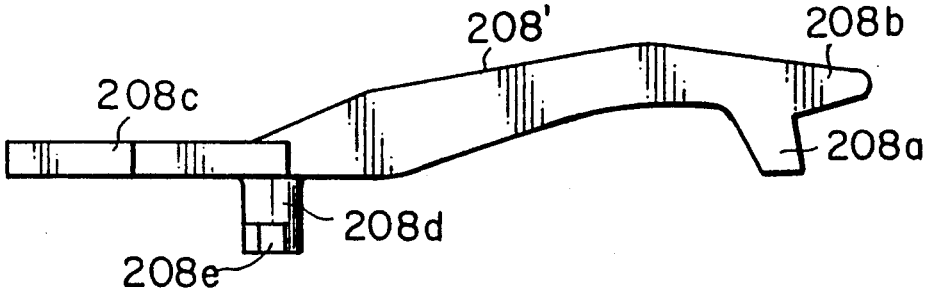
FIGS. 21A and 21B are a side elevational view and a front elevational view for showing a lock sensor arm.
Figure 21B:
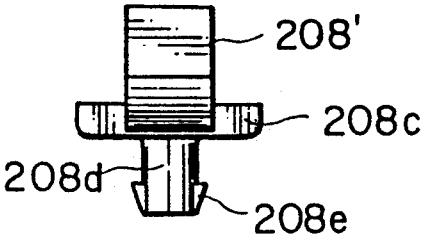

As already described in FIG. 1, the lock sensor arm 208' has an abutting part 208*a* and a supporting part 208*b* at its extreme end at the other end it has an attitude holding plate 208*c* and a sliding guide lever 208*d*. The sliding guide lever 208*d* is inserted into the guide longitudinal hole 213 while engaging with the surface groove 207*a* of the base portion 207, and a flexible engaging piece 208*e* arranged at its extreme end is engaged with the rear surface 207*b* so as to provide a stopper (see FIGS. 21 and 22).

At the rear surface 207*b*, the short circuiting automatic lock confirming resilient piece G is attached through a fixing lever 214. The short circuiting automatic lock confirming resilient piece G has an engaging piece $G_3$ formed with a fixed contact part $G_2$ projected through its bending at one side of the fixing wound part $G_1$, has at the other side has a resilient piece $G_5$ provided with a movable contact part $G_4$ at its extreme end. The engaging piece $G_3$ is engaged with a projection 215 under a fixing condition in which the fixing wound portion $G_1$ is engaged with the fixing lever 214 and at the same time the resilient piece $G_5$ is engaged with the sliding guide lever 208*d* of the lock sensor arm 208', resulting in that the lock sensor arm 208' is always biased forwardly by the resilient piece $G_5$.

The supporting member E' is fixed to the male connector housing A' while the grooves 211 being engaged with the rails 210, and the engaging portions 216 are engaged with the engaging projections 217 and fixed, thereby the lock sensor arm 208' is moved rearwardly by the engaging portion 205*c* to store a force.

Figure 24A:
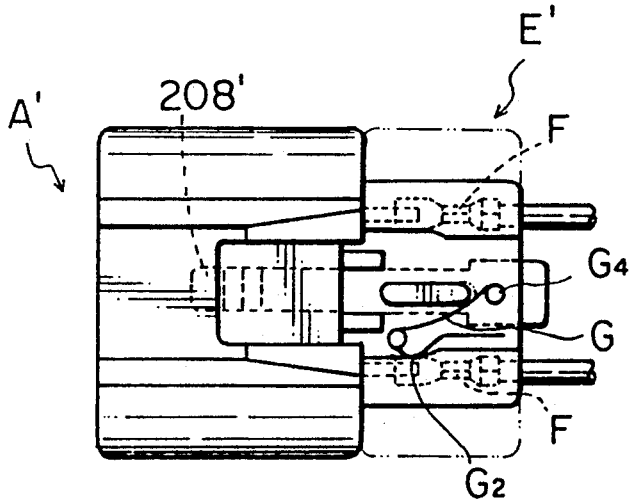
FIGS. 24A and 24B are top plan views of the connector housing to show a relation with the lock sensor
Figure 24B:
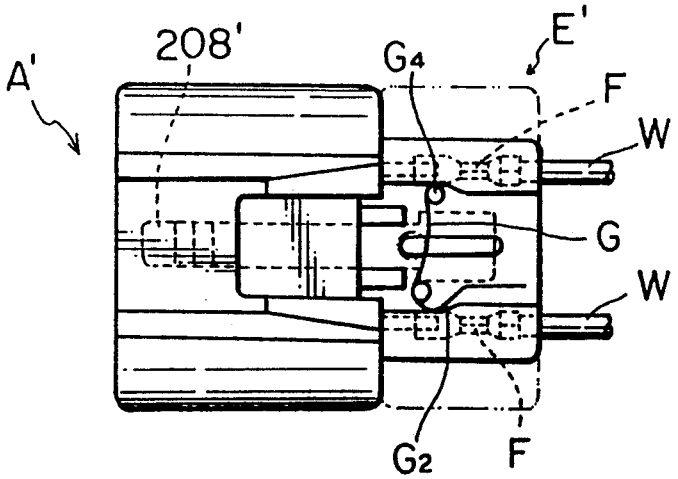
Figure 25:
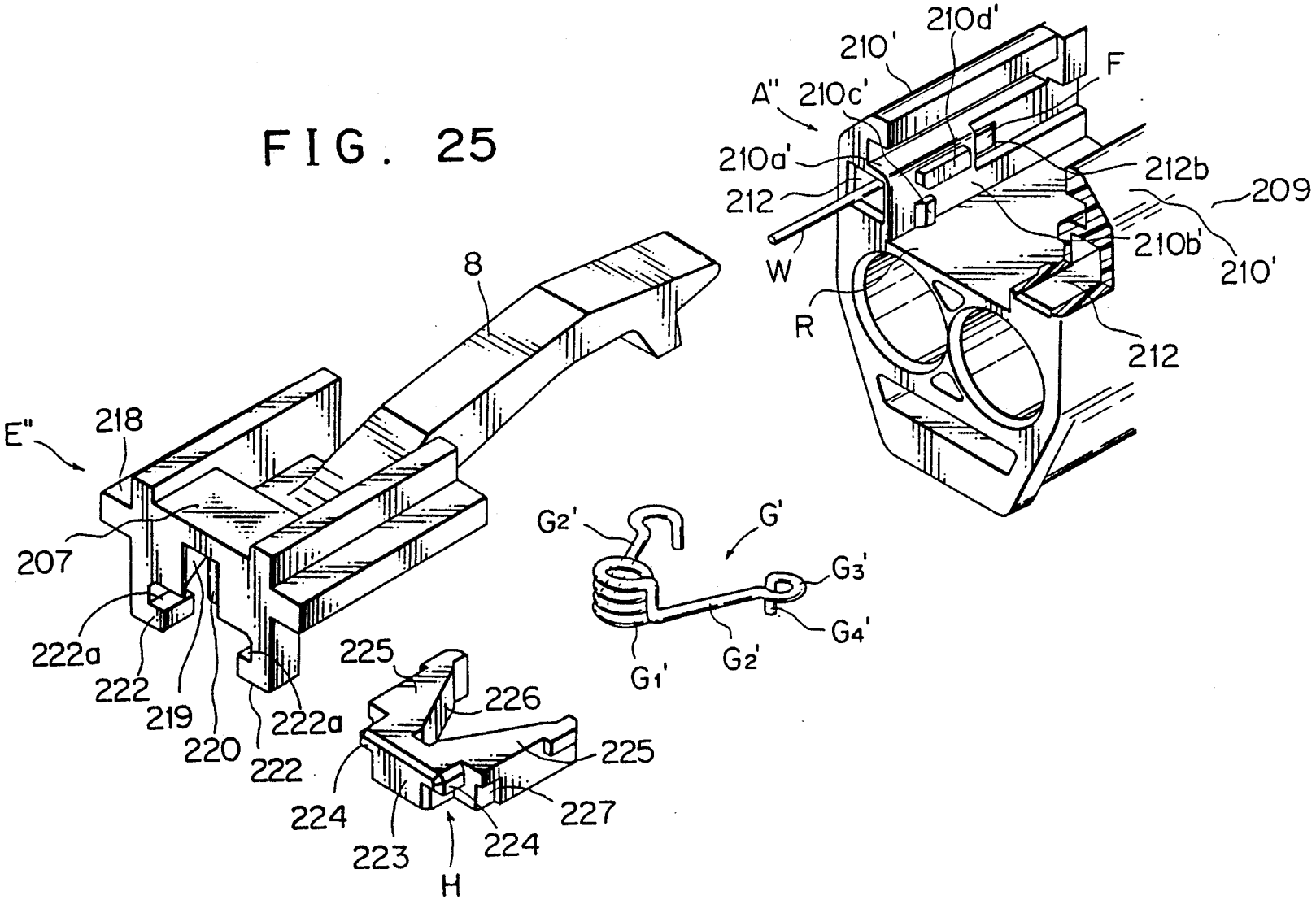
FIG. 25 is an exploded perspective view for showing another preferred embodiment of the present invention.

With such an arrangement as above, although the fixed contact part $G_2$ is always contacted with one sensor circuit terminal F through the opening 212*b*, the lock sensor arm 208' is retracted under a non-fitted state, so that the resilient piece $G_5$ is displaced rearwardly and the movable contact part $G_4$ is in a non-contacted state with the other sensor circuit terminal F (FIG. 24A). When the male connector housing A is completely fitted to its mating connector housing, the lock sensor arm 208 is moved forward by the resilient piece $G_5$, the movable contact part $G_4$ is contacted with the other sensor circuit terminal F so close the sensor circuit (FIG. 24B).

In the aforesaid example, the supporting member is indicated as a separate member from the connector housing and its integral arrangement may also be available.

Figure 22:
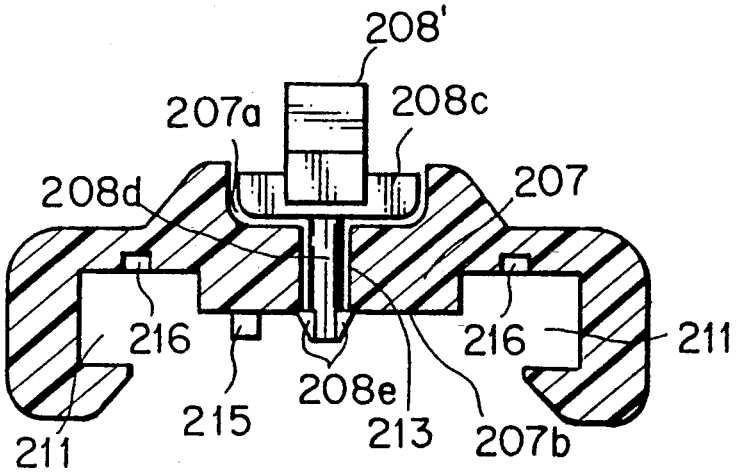
FIG. 22 is a sectional view for showing a supporting part of a lock sensor arm.
Figure 23A:
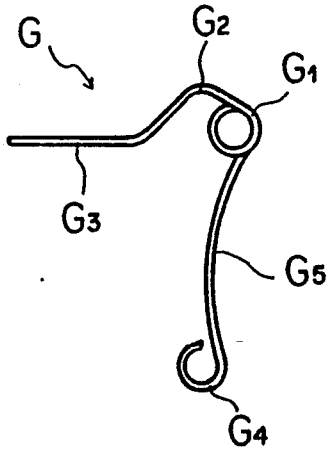
FIGS. 23A and 23B are a top plan view and a side elevational view for showing a short circuiting and automatic lock confirming resilient piece.
Figure 23B:
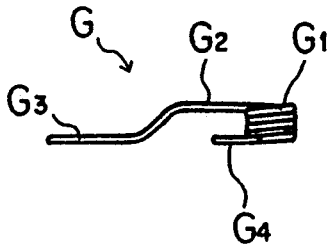

FIGS. 22 to 32 illustrate another preferred embodiment of the present invention. As shown in FIG. 22, it is comprised of a male connector housing A'', a lock confirming slider E'' having a lock sensor arm 208, a short circuiting automatic lock confirming resilient piece G' and a biasing operating element H.

In the male connector housing A'', a pair of supporting frames 210' are extended rearwardly from a rear part of a jacket 209 to form a storing space R. Each of the supporting frames 210' is formed with a groove 210*a'* directed toward the storing space R and with a terminal storing chamber 212 opened rearwardly.

Into the terminal storing chamber 211 is inserted and engaged a small-sized sensor circuit terminal F connected in advance to the electrical wire W in the same manner as that of the aforesaid preferred embodiment. The sensor circuit terminal F is placed adjacent to the storing space R from an inner opening 212*b*.

A wall 210*b'* at the storing space R of each of the supporting frames 210' is provided with engaging projections 210*c'* and 210*d'* for preventing a later removal and a floating of the biasing operating element H.

Both sides of the base portion 207 of the lock confirming slider E'' are formed with the sliding portions 218 engaged with the grooves 210*a'*. A fixing lever 220 is vertically arranged within a concave part 219 at a rear part of a rear surface. At both sides of the concave part 219 are projected restricting walls 221 and 221 expanding forwardly in tapered form, and at the opposing sides a pair of supporting frames 222 and 222 having supporting grooves 222*a* are vertically arranged.

The short circuiting automatic lock confirming resilient piece G' has resilient displacing portions $G_2'$, $G_2'$ expanded in V-shape in respect to the fixing wound part $G_1'$ and it has at a free end of each of the resilient displacement part $G_2'$ a movable contact portion $G_3'$ and a rised driven part $G_4'$.

The biasing operating element H has engaging portions 223 and 224 for a pair of supporting frames 222 of the lock confirming slider E'', has forked restricting portions 225 and 225 at its forward side and has a V-shaped driving surface 226 at an inner surface over a pair of restricting portions 225 and 225. A rear side surface of the restricting portion 225 is formed with an engaging concave part 227.

Figure 26:
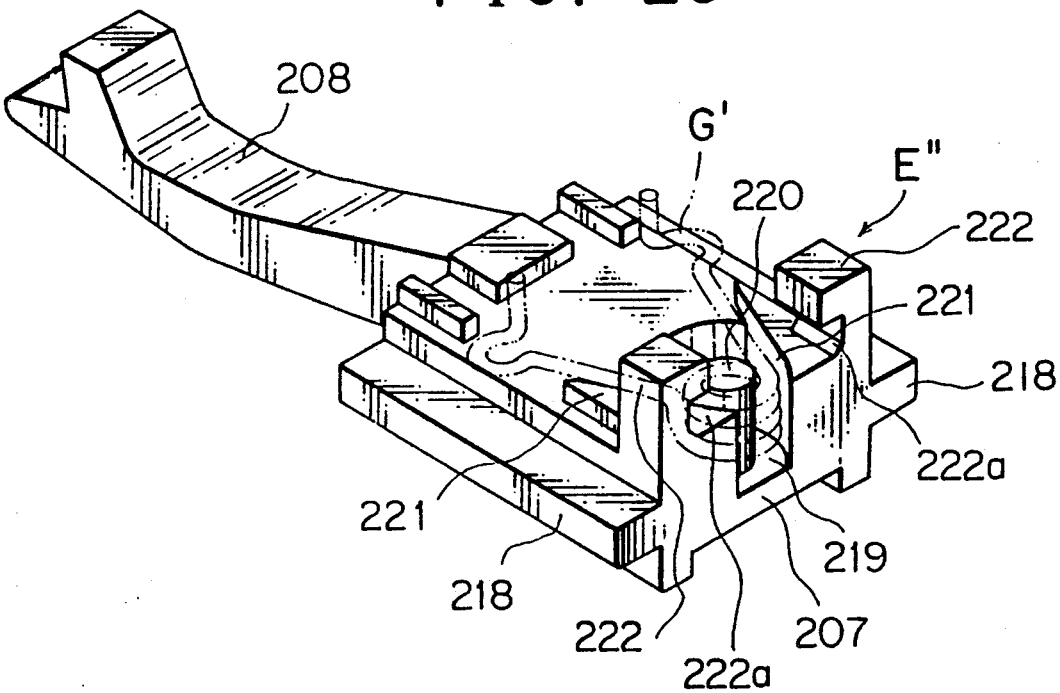
FIG. 26 is a perspective view for showing a lock confirming slider.
Figure 28A:
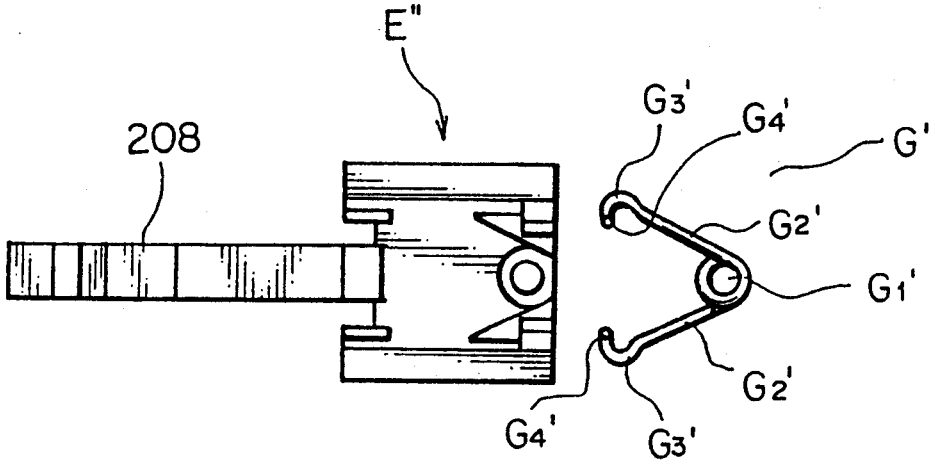
FIGS. 28A, 28B and 28C are illustrative views for showing processes in which a short circuiting and automatic lock confirming resilient piece is assembled in the lock confirming slider.
Figure 28B:
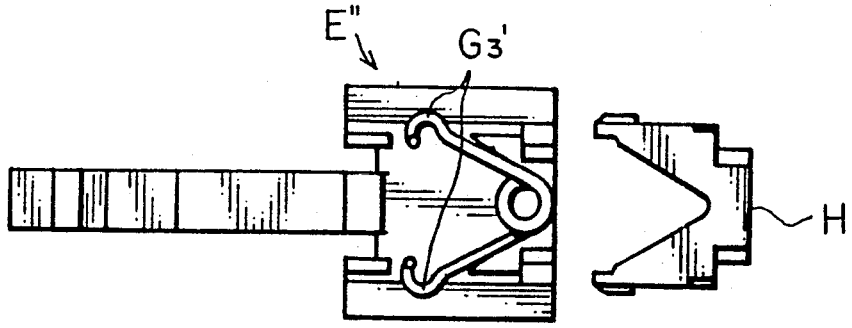

With such an arrangement above, in order to assemble these elements, the short circuiting automatic lock confirming resilient piece G' is assembled against the lock confirming slider E'' (FIG. 26 and FIG. 28B). Under this state, the fixing wound part $G_1'$ is engaged with the fixing lever 220 within the concave part 219 and the resilient displacement portions $G_2'$ and $G_2'$ are forcedly contacted with the tapered restricting walls 221 and 221.

Figure 27:
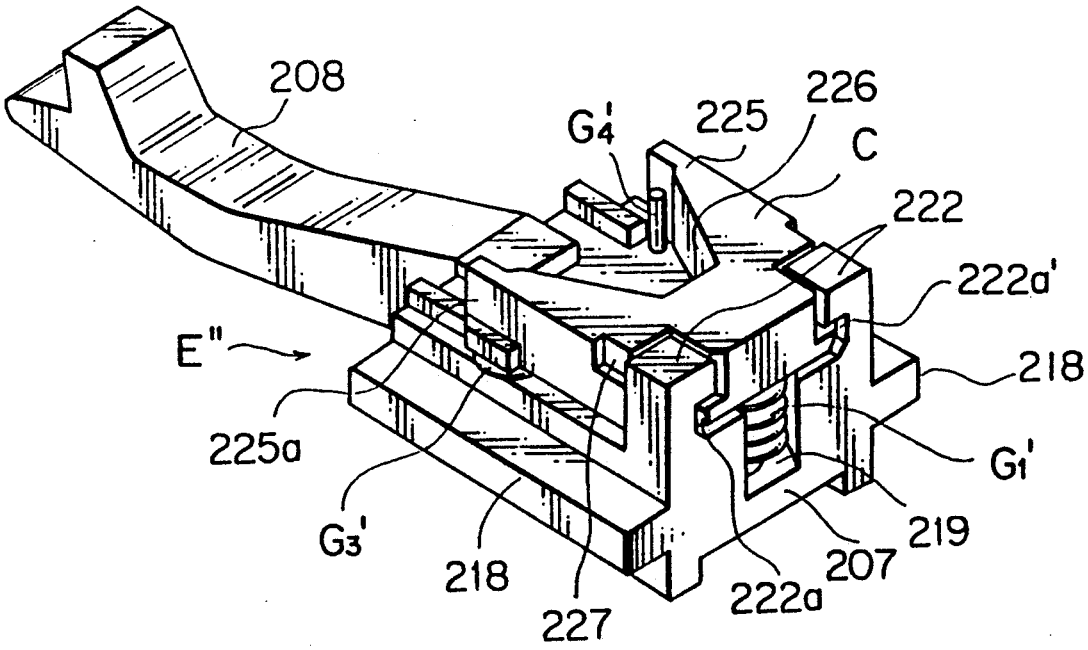
FIG. 27 is a perspective view for showing a lock confirming slider to which a biasing operation member is assembled.
Figure 28C:
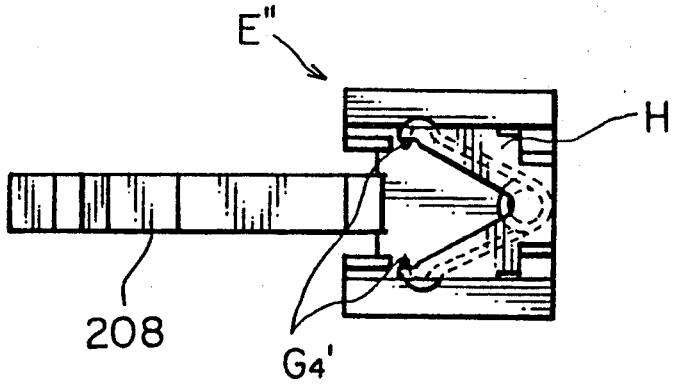

Then, the biasing operating element H is assembled with the lock confirming slider E" while the engaging portions 223 and 224 are being engaged with the supporting frame 222 and its groove 222*a*. Under this state, the resilient displacing part $G_2'$ of the short circuiting automatic confirming resilient piece G' is positioned below the restricting part 225 of the biasing operating element C and a movable contact portion $G_3'$ at its free end is projected outwardly from a free end 225*a* of the restricting part 225 and at the same time the driven part $G_4'$ is raised inside the free end 225 (FIG. 27, FIG. 28C).

Figure 29:
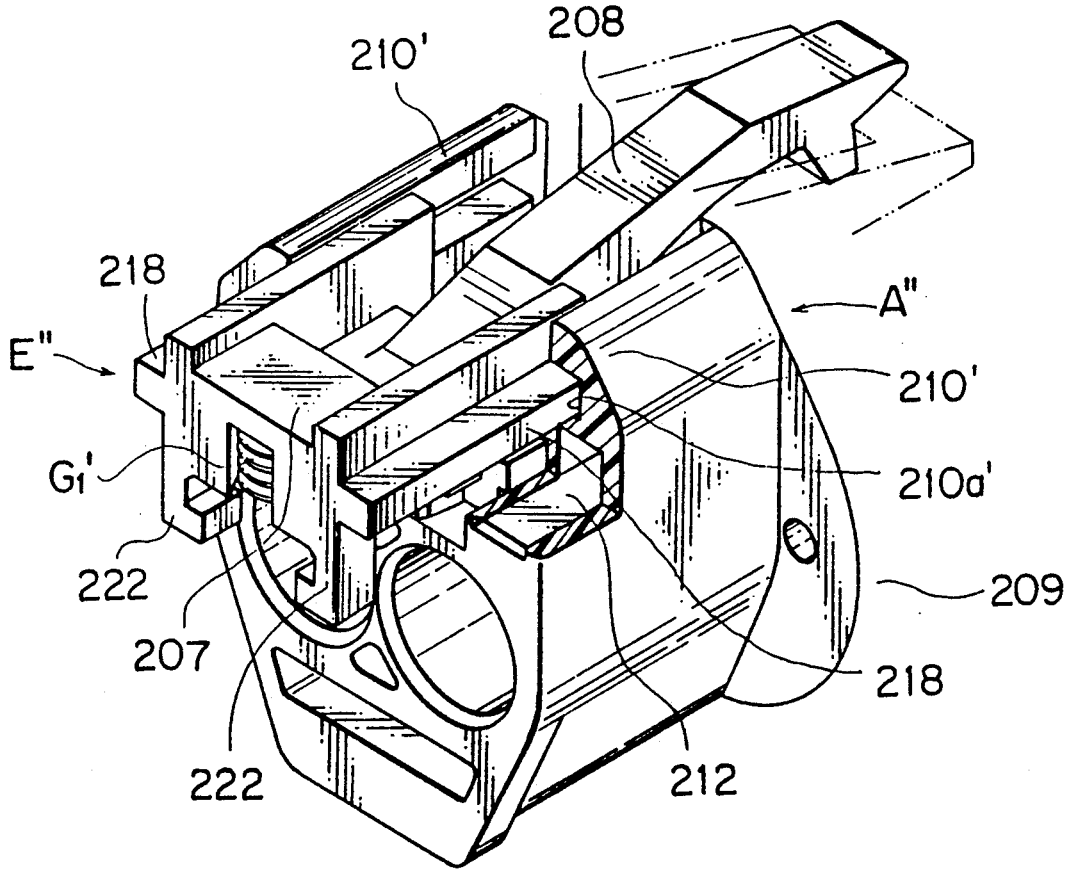
FIG. 29 is a perspective view with a part of the preset state being broken away.
Figure 30:
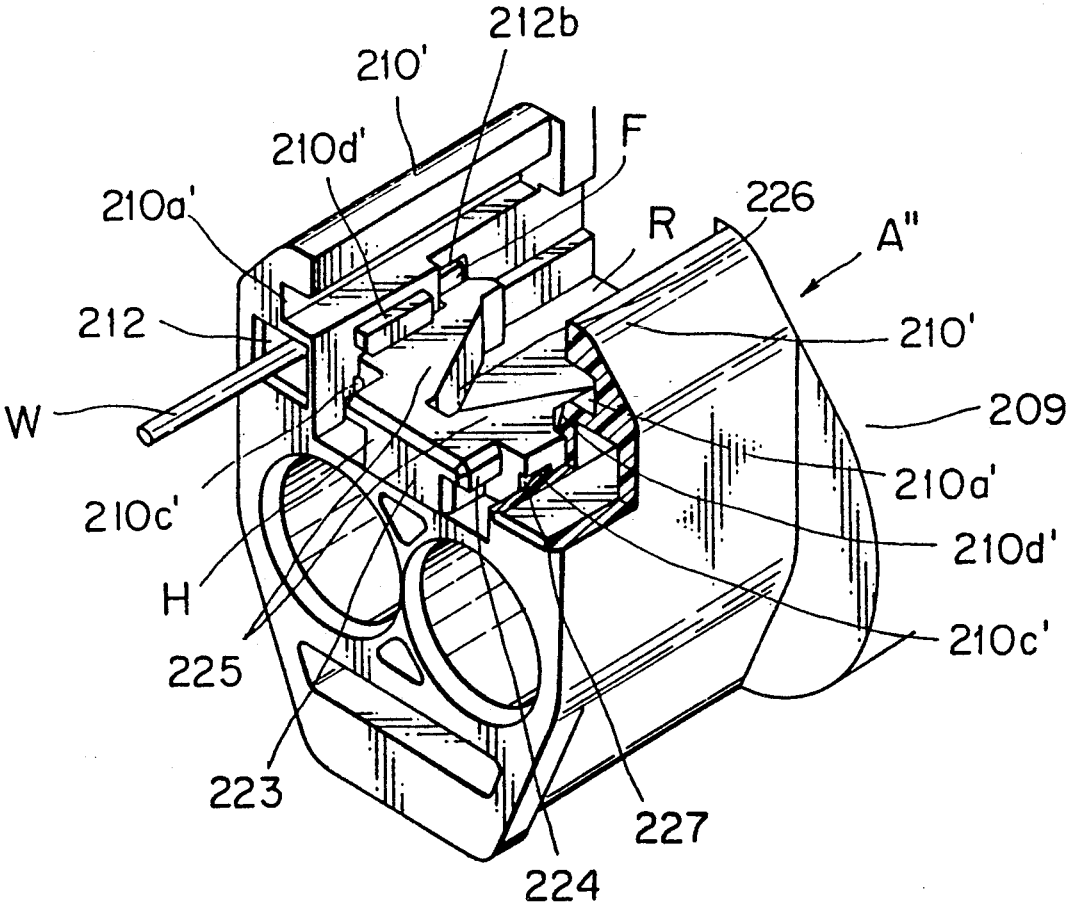
FIG. 30 is a perspective view with a part being broken away to show an engaged state between the biasing operating member and the connector housing.
Figure 32A:
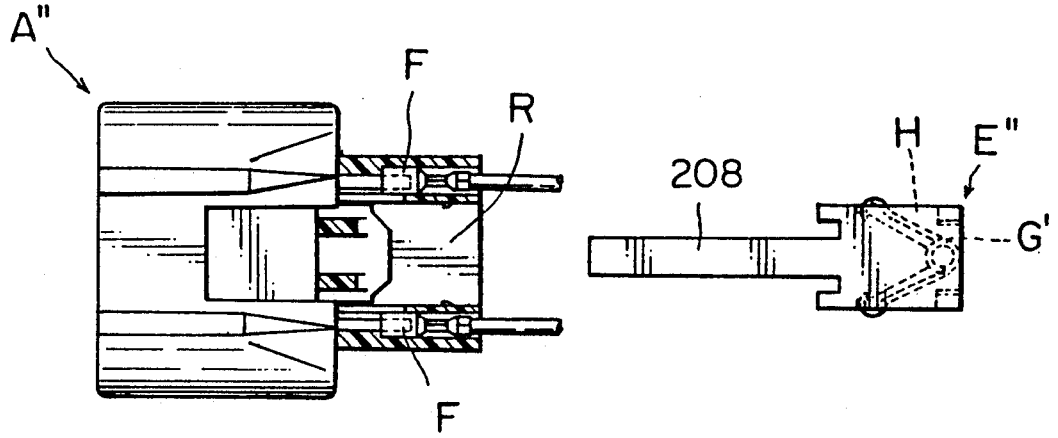
FIGS. 32A to 32E are illustrative views for showing processes in which the lock confirming slider is assembled to the connector housing.
Figure 32B:
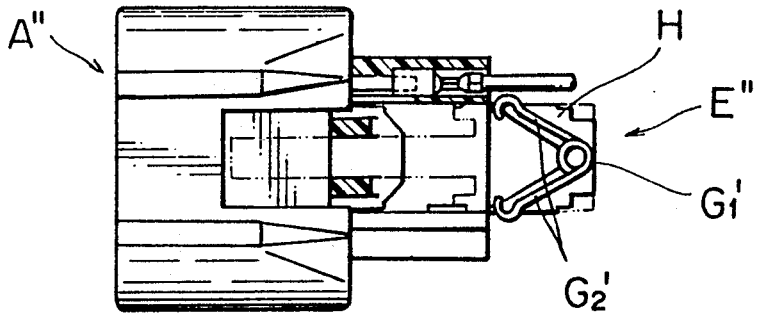
Figure 32C:
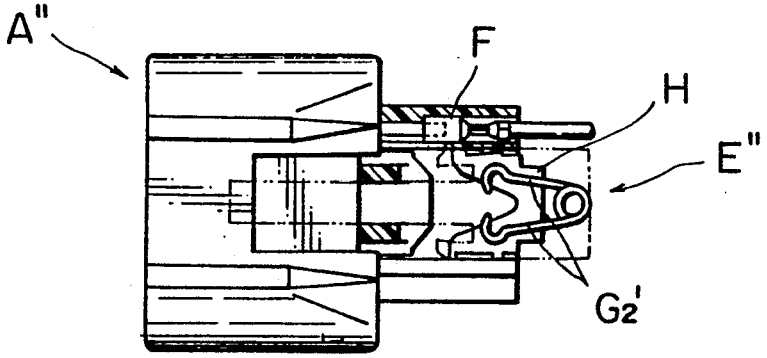
Figure 32D:
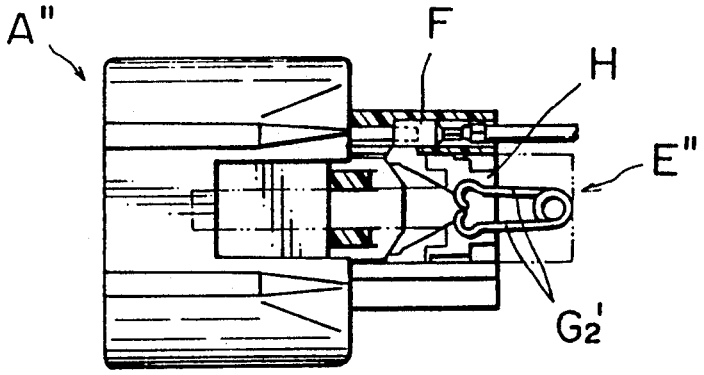

As described above, the lock confirming slider E" having the short circuiting automatic lock confirming resilient piece G' and the biasing operating element H is coupled at its rear part to the male connector housing A", wherein it is pushed into the storing space while a pair of sliding portions 218 are being engaged with grooves 210*a*' of a pair of supporting frames 210' (FIG. 32B) and the lock sensor arm 208 is engaged with the lock arm 205 through its advancing movement, resulting in that the lock confirming slider E" may not be moved forward more and at this state, only the biasing operating element H is started to be pushed (FIG. 32C). Upon completion of the pushing operation, the biasing operating element H is fixed by the engaging projections 210*c*' and 210*d*' (FIGS. 29 and 30). Under this state, the resilient displacement part $G_2'$ is forcedly displaced inwardly through the driven part $G_4'$, resulting in getting a preset state accumulating a resilient force (FIG. 32D).

Figure 31:
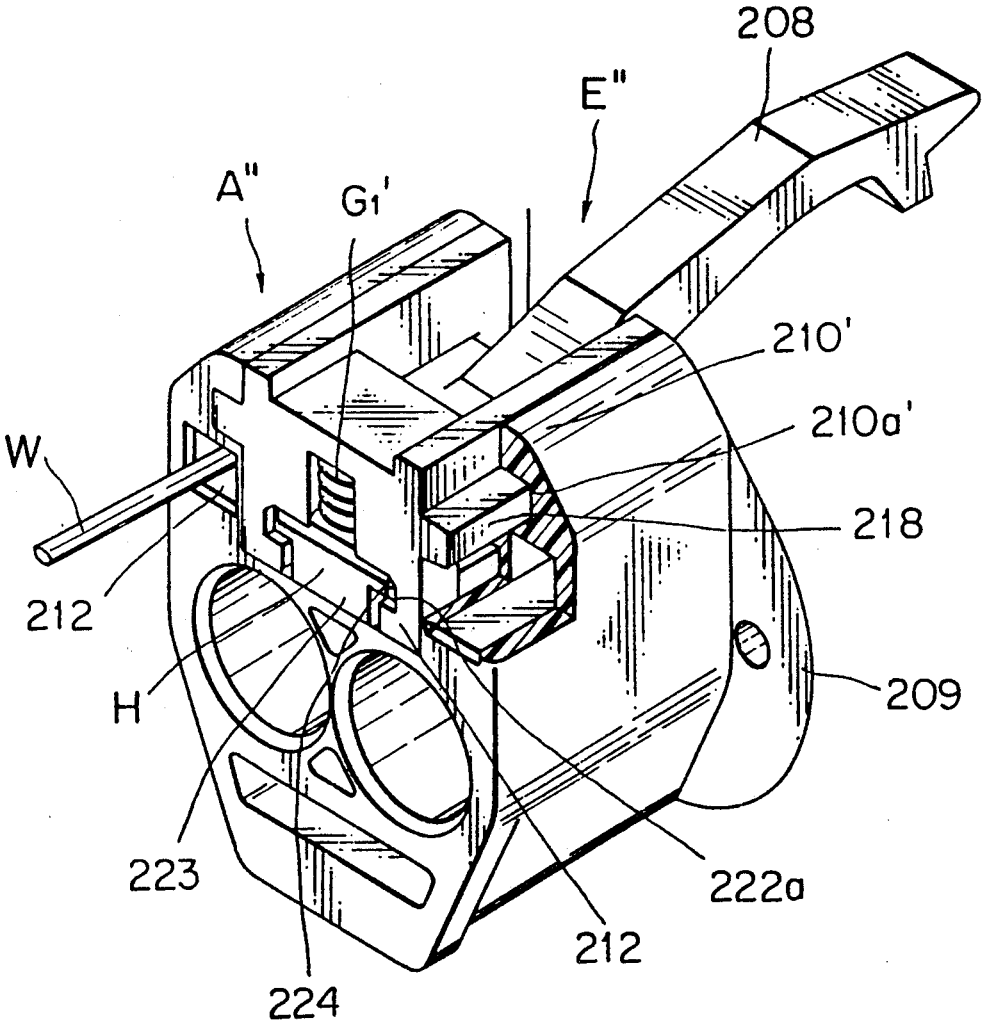
FIG. 31 is a perspective view with a part being broken away to show an entire complete fitted state.
Figure 32E:
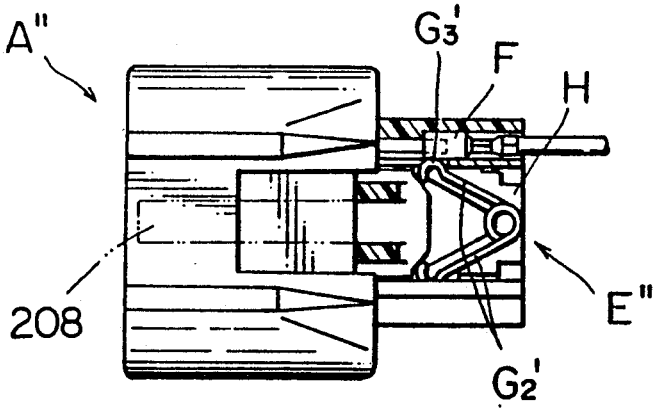

Under the preset condition, as the male connector housing A" is fitted to its mating female connector housing, as shown in FIG. 1, the lock sensor arm 208 releases its restriction with the lock arm 205, the lock confirming slider E" is moved forward through an operation of the resilient displacing part $G_2'$ in its expanding direction, each of the movable contact portions $G_3'$ of the short circuiting automatic lock confirming resilient piece G' is contacted with a pair of sensor circuit terminals F to operate the sensor circuit (FIG. 31, FIG. 32E).

As described above, the present invention is comprised of a first connector housing having a flexible lock arm, a second connector housing having an engaging part in respect to the flexible lock arm, and a lock confirming slider arranged at the first connector housing and movable in a forward direction when both connector housings are completely fitted to each other, wherein sensor circuit terminals and a short-circuiting terminal are arranged in opposition to one connector housing and the lock confirming slider and at the same time springs are arranged between them, the lock confirming slider is moved forward by the springs when both connector housings are completely fitted so as to cause the sensor circuit terminal and the short-circuiting terminal to be contacted to each other, resulting in that the sensor circuit can be operated automatically when the pair of connector housings are completely fitted to each other.

One connector housing is provided with the sensor circuit terminal and the short circuiting automatic lock confirming resilient piece, the lock confirming slider is automatically moved forward by the short circuiting automatic lock confirming resilient piece when both connector housings are completely fitted and the short circuiting automatic lock confirming resilient piece is contacted with the sensor circuit terminal. One connector housing is provided with the sensor circuit terminal and at the same time the lock confirming slider is provided with the short circuiting automatic lock confirming resilient piece, the short circuiting confirming slider is automatically moved forward by the short circuiting automatic lock confirming resilient piece when both connector housings are completely fitted to each other. The short circuiting automatic lock confirming resilient piece is contacted with the sensor circuit terminal, resulting in that the sensor circuit can be automatically operated when a pair of connector housings are completely fitted to each other.

What is claimed is:

1. A detector device for coupled connectors comprising:

a first connector housing having a flexible lock arm;

a second connector housing having an engaging part in respect to said flexible lock arm;

a lock confirming slider;

sensor circuit terminals provided in the first connector housing;

a short circuit terminal provided on the lock confirming slider; and springs placed between the first connector housing and the lock confirming slider, the lock confirming slider being moved forwardly in the axial direction to contact the sensor circuit terminals and the short-circuiting terminal each other when the first and second connector housings are completely fitted to each other.

2. A detector device for coupled connectors as claimed in claim 1, wherein said lock confirming slider includes a lock sensor arm being integrated with the lock confirming slider.

* * * * *